United States Patent [19]

Bouchal

[11] Patent Number: 4,684,135

[45] Date of Patent: Aug. 4, 1987

[54] STORY TELLING GAME

[76] Inventor: Robert A. Bouchal, 48 Liberty Ave., Somerville, Mass. 02144

[21] Appl. No.: 620,956

[22] Filed: Jun. 15, 1984

[51] Int. Cl.[4] ..... A63F 3/06; A63F 1/00; A63B 71/00; G09B 19/00

[52] U.S. Cl. ..... 273/269; 273/236; 273/299; 273/148 A; 434/236

[58] Field of Search ..... 273/236, 287, 243, 271, 273/146, 299, 269; 434/236

[56] References Cited

U.S. PATENT DOCUMENTS

| | | | |
|---|---|---|---|
| 1,038,062 | 9/1912 | Albert | 273/269 |
| 1,539,895 | 6/1925 | Buzza | 273/146 |
| 1,699,132 | 1/1929 | Buchanan | 273/236 X |
| 3,770,119 | 11/1973 | Hultberg et al. | 206/564 X |
| 3,891,209 | 6/1975 | Kritzberg | 434/236 X |
| 3,940,863 | 3/1976 | Kritzberg | 273/236 X |
| 4,201,405 | 5/1980 | Rannenberg | 40/119 X |
| 4,486,018 | 12/1984 | Keller, Jr. | 206/315.1 |

FOREIGN PATENT DOCUMENTS

| | | | |
|---|---|---|---|
| 41437 | 10/1907 | Switzerland | 40/119 |

OTHER PUBLICATIONS

"Impromptu Stories", The Cookesbury Game Book, p. 122, ©1939.

"Family Coach", Every Little Boy's Book pp. 30, 31 copy obtained 1885.

*Primary Examiner*—Richard C. Pinkham
*Assistant Examiner*—Benjamin Layno
*Attorney, Agent, or Firm*—Herbert L. Gatewood

[57] ABSTRACT

A game is provided for stimulating innovation and exercising fundamental thinking and communication skills. Each game player is provided with a game card which is imprinted with pictorial illustrations and legends characterizing a predetermined number of different kinds of stories which each player is to tell during the course of play. Each player in turn randomly selects the primary characteristics of a story to be told. The player then randomly selects a randomly predetermined number of graphic images, these being then used by the player in telling a story of the previously selected character. On successfully completing the telling of the story, the player is given a frame to place about the particular pictorial illustration bearing the characterizing legend for the story just told. The game is completed when a player has first provided frames about all the pictorial illustrations on his game card.

19 Claims, 7 Drawing Figures

10
22
150
152
158
160
156
154
54
42
12
46
14
20
56
60
28
98
118
106
90
38
102
24
32
40
86
112
104
114
138
64
124
132
18
146
88
92
108
110
116
100
70
128
78
148
143
145
68
72
130
16
147
134
80
149
129
62
142
74
140
144
34
120
126
76
82
26
136
66
84
30
36

STORY TELLING GAME

BACKGROUND TO THE INVENTION (a) Field of the Invention

This invention relates, in general, to a device or tool and techniques for stimulating innovation and exercising fundamental thinking and communication skills. More particularly, the invention is a game using randomly selected images in the telling of a randomly predetermined type of story. Even more particularly, the invention involves a particularly constructed story telling game, a novel and unique receptacle for housing the game components, and the manner and technique of play. In a still more particular invention, there is provided a perpetual calendar of unique construction which can be used either as a game component or calendar, or both, as desired.

(b) Description of the Prior Art

The use of word and image stimuli in fostering verbalization and in the development and telling of stories is well known. For example, U.S. Pat. No. 1,379,871, which issued May 31, 1921 to William D. McGuire, Jr., discloses a set of cards each having depicted thereon a scene, an object or descriptive matter used as a device not only for entertainment but also to develop the faculties of imagination and judgment. The cards have as an object the provision of a game or puzzle, the solution of which requires the development of a plot, theme or story. Accompanying the set of cards is a printed sheet suggesting the theme of the story or plot presented in the picture play depicted on the cards. In play, the players know in advance the title for the particular set of cards selected and will have a synopsis giving the theme of the story or picture play. All the cards in the set are dealt out to the several players. The person having the first card, which might be designated as such, makes the first play by placing the card face up on the playing table. The next player has to either produce the next card in the sequence of the story or else answer "I pass", as is usual in playing card games. As disclosed in the patent, a key can be provided with the card set giving the proper sequence of the cards in order to portray the story or play.

In U.S. Pat. No. 3,891,209, a game is disclosed which is used in psychological testing and therapy. This game comprises two different sets of cards. On each card in each set there is provided a plurality of words. The words on the cards in one set all tend to evoke the same primary emotions. And the words on each card in the other set of cards tend to evoke different primary emotions. The words on the cards are used as a jumping off point for story telling, after a particular set of cards is randomly selected by a player. The player receives an award of two gold stars if he successfully tells a story. The number of gold stars that a player receives may determine the winner in any playing session, or, as disclosed in the patent, the gold stars can be turned in for other awards.

A number of different word games are disclosed in *A GAMUT OF GAMES*, Pantheon Books, New York, N.Y. One such a game, i.e., "Lexicon", uses fifty two letter cards, the object being, to be the first to play out a hand into a crossword layout. Another type word game, "Boggle", involves sixteen letter cubes shaken into a square. Players list words they find by going from letter to letter in any direction. A third type of word game, "Scrabble", involves letter tiles played on a board in crossword fashion. Still, a fourth type word game involves a game wherein whole words are used in the play. For example, in the game "Facts In Five", five categories are chosen from cards and five letter tiles are turned up. Each player, in five minutes, tries to write a word for each category, starting with each letter.

Other "games" disclosed in *A Gamut of Games* like that disclosed in U.S. Pat. No. 3,891,209 are in some way tied in with personality and analysis. These are not really games as such. They involve no competition even though played with others. For example, "Reunion" gives a person the opportunity to relate to a number of pictures, to imagine a happening, to use his intuition, or to recall a childhood memory.

Cards bearing pictorial illustrations are used by teachers to develop association and generalization skills. For example, there is shown in *Teaching Resources,* 1979 Catalog, at page 35, a flip chart book containing two rows of superposed pictures of common objects. The pictures in one row can be paired with any picture in the other row and compared by, e.g., a student, for likenesses and differences.

None of the games heretofore invented, or, any of the word and image stimuli of which I am aware, however, involve the actual telling of a story based on a randomly preselected number of graphic images. Games involving a story such as disclosed in U.S. Pat. No. 1,379,871 do not require the players to tell a story based upon the graphic images in the cards involved. Instead, the players are required to play the cards involved in a certain pictorial sequence, that sequence itself telling the story and requiring no verbalization thereof by a player.

In U.S. Pat. No. 3,891,209, story telling is involved; however, graphic images do not form the basis for the story telling. The basis for a story told involves words on a card.

SUMMARY OF THE INVENTION

There is provided in accordance with the basic aspects of this invention a device or means which has as its primary object the stimulation of innovation and the exercising of fundamental thinking and communication skills. Quite advantageously, the invention is in the form of a game which provides not only inspiration but education and entertainment as well. The game, moreover, allows for the inclusion of material that specifically references those concepts that players wish to consider, while the perpetual calendar included therein, as hereinafter disclosed, serves as a daily reminder of the brainstorming approach to problem solving.

The game of the invention in its most basic aspects comprises a plurality of first named planar members of predetermined size and shape, a plurality of spaced-apart pictorial illustrations being affixed to and on each of said first named planar members, each said pictorial illustration being provided with a legend specifying a primary characteristic of a story to be told, a plurality of second named planar members, an image being affixed to and on each said second named planar member, means for randomly determining a predetermined number of said second planar members, for use by a game player in telling a story, means for randomly determining the primary characteristics of the said story to be told, and means for use in association with said first named planar member and each said pictorial illustration and legend thereon for recording and indicating that said story selected has been told by a player.

Quite advantageously, the game is stored, while not in use, in a receptacle of novel and unique construction comprising, in its basic aspects, a base unit and a cover. Recesses are provided in the top surface of the base unit for storing and maintaining the game components in an orderly fashion. The cover in a more preferred aspect is provided with a recessed window which permits viewing of the said image bearing planar members stored in the base unit.

In a most preferred aspect, the game disclosed herein can function additionally as a decorative wall piece. The receptacle for the game in this case is provided with means for hanging the receptacle, when not in use, on the wall of a room or like. Thus, the image bearing members will be displayed.

Still, as a further advantage, in one embodiment of the invention, certain of the second named planar members, in addition to being provided with an image or graphic art, are each provided with a legend denoting one of the twelve months of the year. Others of such planar members are provided with an array of 31 members, in addition to an image. Thus, there is provided, quite advantageously, a perpetual calendar. This perpetual calendar, in a further advantage, provides a dual function, i.e., it can be used either as a game component, or a perpetual calendar, or both, as desired. As a perpetual calendar, it can be used separate and distinct from the game. The planar members forming the perpetual calendar can be bound together, in flip chart fashion, at their top edges, or provided loose, whichever construction is desired.

BRIEF DESCRIPTION OF THE DRAWINGS

The novel features and operation of the present invention will be better understood from the discussion and explanation which follows hereinafter taken in conjunction with the accompanying drawing, in which.

DETAILED DESCRIPTION OF THE INVENTION AND THE PREFERRED EMBODIMENTS

Figure 1:
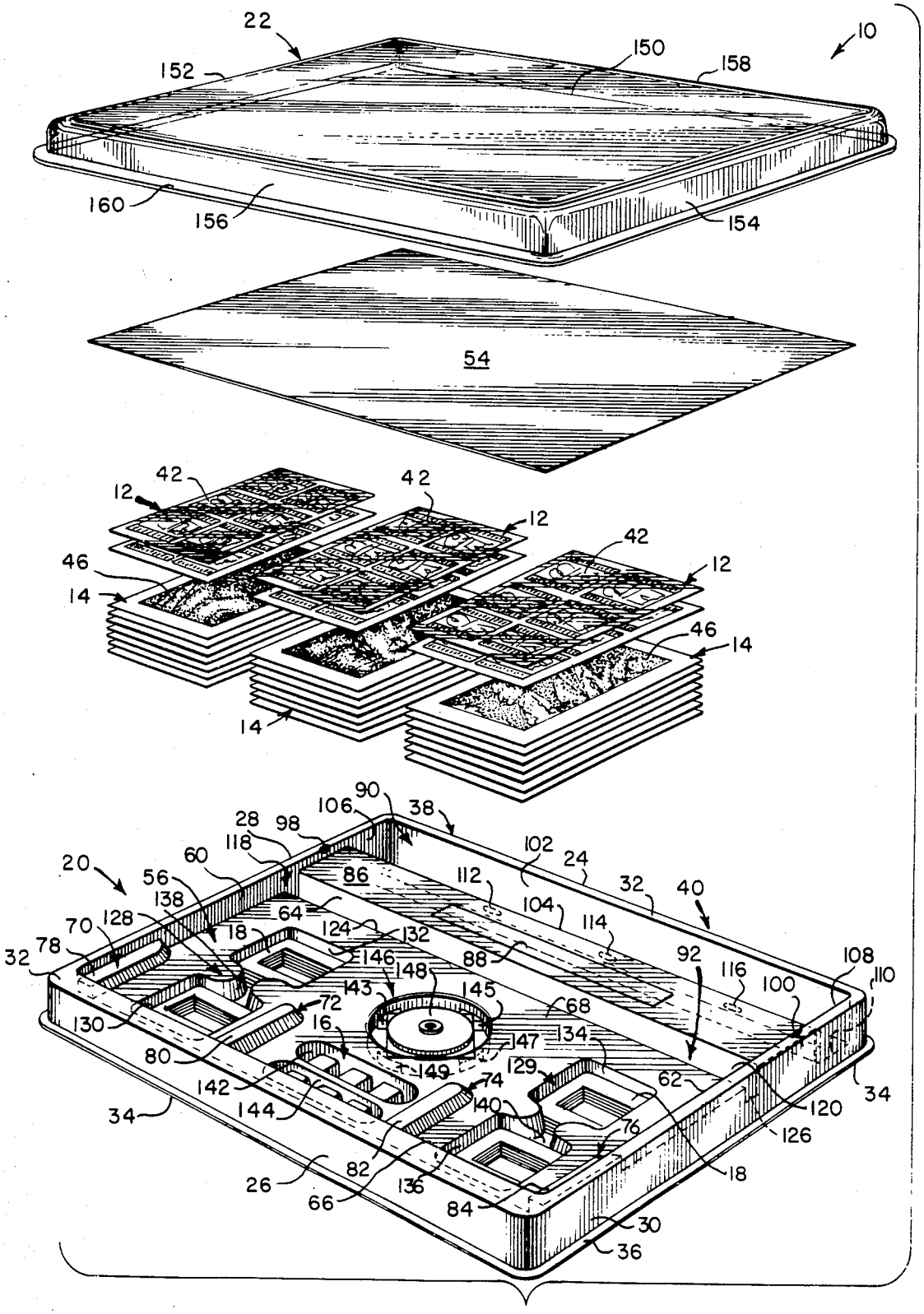
FIG. 1 is an exploded view in perspective showing a preferred embodiment of the game of the invention disclosed herein and its various components, as stored in the game receptacle.

Turning now to the drawing there is shown in FIG. 1 thereof a game 10, in accordance with one aspect of the invention, which comprises as game components a plurality of first named planar members 12, a plurality of second named planar members 14, game cubes 16 (shown in FIG. 2), and frame-like members 18 for use as hereinafter more fully disclosed, in recording and indicating that a player has already told a particular type, or character of story.

The game components when not being used are contained and stored in a rectangular-shaped receptacle comprising a rectangular shaped base unit 20 and rectangular shaped cover 22. As can be seen by reference to FIG. 1, base unit 20 is defined by parallel, vertically disposed side walls 24, 26 and parallel, vertically disposed end walls 28, 30, a planar horizontally disposed top surface 32, and a planar horizontally disposed bottom member 34, parallel to the top surface. The bottom member 34, like top surface 32, is of rectangular shape; however, the bottom member is of somewhat greater overall dimension, whereby a planar horizontally disposed border 36 is provided around the vertically disposed side and end walls. The border 36 can be of uniform width as is shown by the drawing, or, for example, of somewhat greater width at the top edge of the base unit than at the bottom edge, if desired. In some cases, the top surface and bottom member can be of the same overall dimension, if desired, providing no border at all for the base unit. The border, however, provides a supporting surface for the base unit.

Openings 38, 40 (not shown—but spaced apart as indicated by the reference numerals) can be provided in border 36 at the top edge, if desired, providing means for mounting the game receptacle 10 on a wall. Thus, in the most preferred aspect of the invention, where cover 22 is of clear plastic material, a decorative wall hanging can be provided. However, other openings instead for hanging the base unit can be provided, if desired, as later disclosed.

Figure 3:
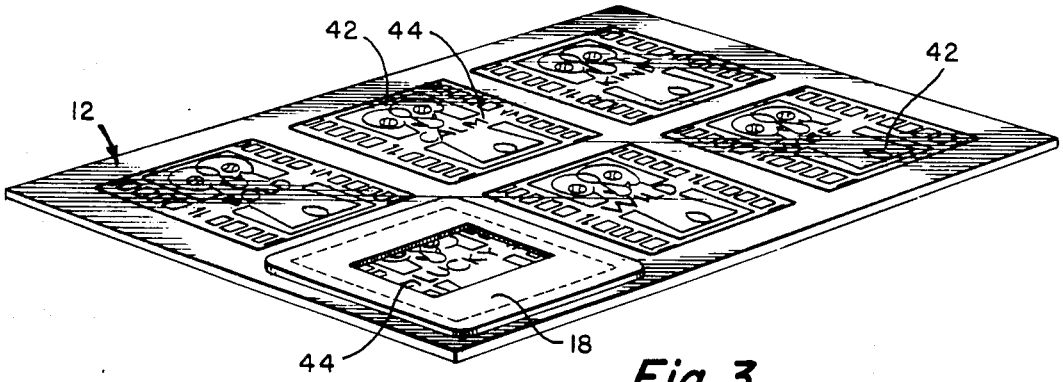
FIG. 3 is a perspective view of a game card.
Figure 4:
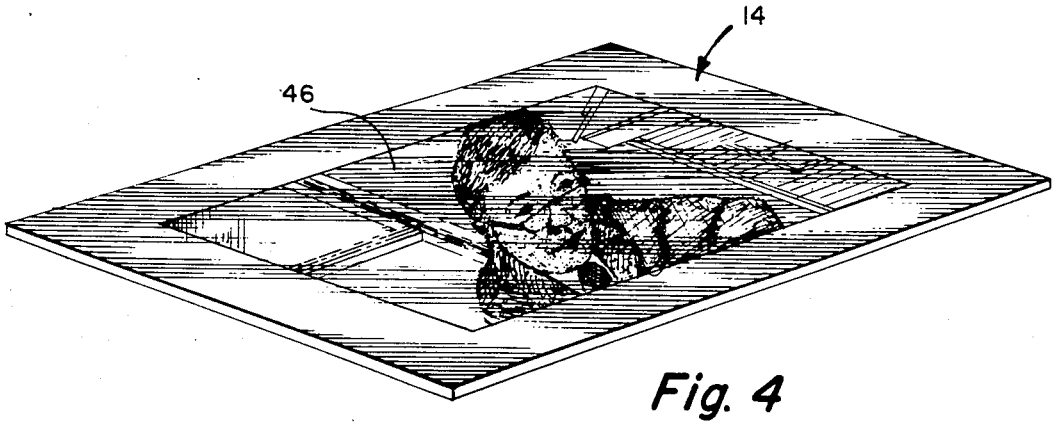
FIG. 4 is a perspective view showing an image card used in the play of the game.
Figure 5:
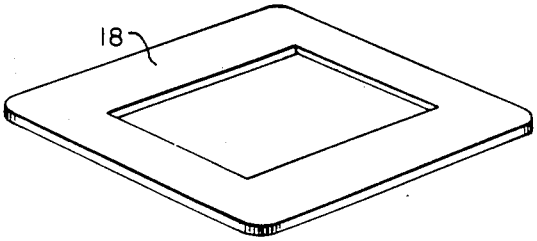
FIG. 5 is a perspective view showing a frame-like member for framing, as shown in FIG. 3, the pictorial illustrations on the game card.

The first named planar members 12 provide a game card which, as later more fully disclosed, are used by each player to record and indicate to the other players which stories have been successfully told by him. Each game card 12, which is of rectangular-shape, is like every other game card. As is shown in FIG. 3, the cards 12 are each imprinted with a plurality of pictorial illustrations 42, the same illustrations being imprinted on each card. And, the pictorial illustrations on each card are the same except that on each pictorial illustration 42, on each card, there is imprinted a different legend, as represented by reference number 44, totalling six different legends, characterizing the six different types of stories that each player is to tell during the game play.

As shown in FIG. 3, the pictorial illustrations 42 are representative of an unframed slide film; however, it will be appreciated that the content of the pictorial illustrations 42 is not a critical feature of the game. The pictorial illustrations on the game cards 12 need not all be the same, even on an individual card. As a matter of fact, the game cards need not necessarily be provided with a pictorial illustration containing an image at all. The main thing about the game cards 12 is that they be imprinted, or otherwise provided with legends such as denoted by reference number 44, as shown in FIG. 3, informing the players as to the primary characteristics of the stories that are to be told. Additionally, the game cards 12 are used by each player not only as a record so that player and the others will know what stories that have been told by a particular player but also to indicate to each player his progress toward completion of the game, relative to the other players.

The pictorial illustrations 44 can be, as was done in the practice of this invention, directly printed onto suitable stock material for the playing cards, or the pictorial illustrations can be separately provided and affixed thereto in any fashion desired, e.g., by adhesive lamination.

On the game card 12 shown in FIG. 3, and which is like one of those used in the practice of the invention disclosed herein, six pictorial illustrations 42 and legends 44 are provided on each game card. Nevertheless, it will be appreciated that a greater number or fewer pictorial illustrations and legends can be provided if desired. The main thing is that each of the game cards 12 not only bear the same number but, also, the same legends so that each player is obligated to tell the same number and type of stories in the play of the game. Six pictorial representations are preferred however, as this will be found to be quite practical in most cases, for the length of time that it takes to play a game with four-six players. Moreover, as will be later disclosed, the preferred means for selecting the character of the story, i.e., the game cubes limits the number of pictorial illustrations and legends to six.

The pictorial illustrations and legends on the game cards 12 used in the practice of the invention, for sake of convenience and symmetry only, are provided in two parallel rows, three columns in each row. Thus, there are provided six pictorial illustrations on each game card 12, the illustrations being arranged in two parallel horizontal rows and three parallel vertical columns; however, it will be readily appreciated that these illustrations can be provided in any arrangement desired.

Further, game cards 12 can be provided in different sets, if desired, depending somewhat on the total number of players that are intended to be accommodated in any one game. The number of players is limited only from a practical standpoint, and for convenience. Thus, six game cards 12, such as is shown in FIG. 3, can be provided, accounting for six different players. The game 10 disclosed herein can be provided with additional sets each of six game cards 12, these being provided with different story characterizing legends. These additional sets can be provided with the game as initially purchased, or separately provided, as desired.

The second named planar members 14, like planar members 12, are of rectangular shape. Preferably, but not necessarily, the dimensions of game cards 12 and image cards 14 are coextensive providing more suitable storage in receptacle 20 as hereinafter more fully disclosed. The image cards 14 are each imprinted with a single, and different, image 46 which images, as hereinafter disclosed, will be used in the practice of the invention by a game player in developing and telling a story of the required character.

The image 46 provided on image cards 14 are not limited in their graphic content. Thus, the images may express, for example, pictorial illustrations, musical notations, verbal and/or numerical information, scents, tastes, sounds, textures, scientific formulations, and combinations of image expressions. As will be appreciated, the images 46 on image cards 14, like the pictorial illustrations 42 and legends 44 on game cards 12, can be either directly imprinted on the planar members, or affixed thereto in other suitable fashion. For example, the images, if pictorial illustrations, can be first printed on photographic paper, which photographs can then be adhesively laminated to heavier stock material.

The number of image cards 14 in a game according to the invention can vary somewhat, as desired. There is, of course, no maximum number, except from a practical standpoint. The minimum number required is at least one card, as a story of various characteristics could be told about a single image. However, it is more desirable that there be a number of different image cards, offering a variety of opportunities to the player in developing and telling a particular story. Most desirably, as will be appreciated from what is disclosed hereinafter, there will be 19 image cards 14.

The game cards 12 and image cards 14 can be manufactured from various available stock material as desired and in accordance with various known techniques. For example, the stock material can be of conventional 12 point card stock such as used for picture postcards. This stock can be imprinted with the desired pictorial illustrations, etc. and then cards of suitable size and shape die-cut therefrom. The stock material need not be that above-mentioned and can be any such material conventionally used now in the manufacture of playing cards. The stock material used will desirably be coated on at least one side to provide better printability characteristics.

The game cubes 16, like conventional dice found in games, can be of various materials as desired, for example wood, plastic, etc. Also, the game cubes 16 can be of any convenient size desired, as conventionally occurs. The basic game will have three different game cubes, namely a conventionally marked die 48, a first story defining cube or die 50, and a second story defining cube or die 52. The faces of the die 48 are each provided with a number of dots signifying the numbers 1–6. The faces of the first story defining cube 50 are each provided with a different legend, each of which will determine how a story's content should be predominantly characterized, e.g., Bold, Calm, Kind, Lucky, Wild, or Wise. As will be appreciated, the first story defining cube 50 is not limited to these particular legends. Others can be provided, if desired, for example to name a few, happy, sad, angry, scary, funny, fair, etc. These, and other suitable legends, as desired, can be provided on additional game cubes, these being provided with the basic game, as alternatives to be used in the playing of the game, or the additional game cubes can be provided separately as an adjunct to the game. Nevertheless, the important thing is that whatever other legends are provided on a particular game cube, a story cube 50 will always desirably bear the legend "Wild", the reason for which will soon be disclosed.

It will be appreciated also that whatever the legends on the first story defining cube 50, those legends on the game card 12 must be corresponding. Thus, if other sets of game cards 12 are provided with the game, or separately, there will need also be furnished a suitably appropriate first story defining cube.

Figure 2:
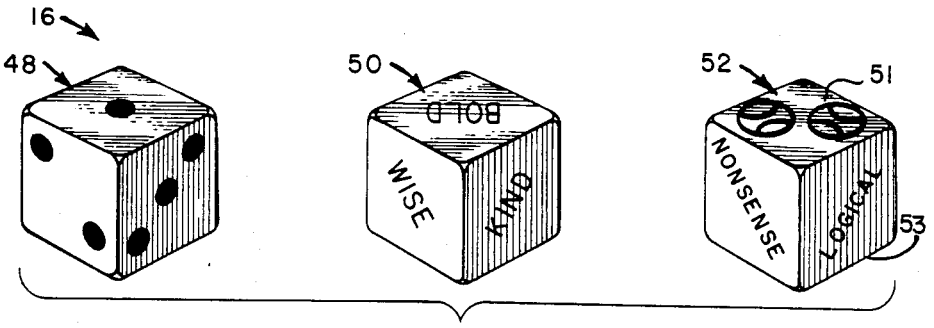
FIG. 2 is a view showing in perspective one set of game cubes used in the game according to the invention.

The second story defining cube 52 further characterizes and limits the type of story that a player must tell. The faces of this die, as shown in FIG. 2, can be imprinted alternately with the legends "Logical" or "Nonsense", thus determining whether a particular story to be told is to be logical, i.e., bound by the accepted notions of sanity, time, space, gravity, mass, energy, genetic action, electromagnetic forces, physiological needs and limits, etc. or can be nonsense, i.e., free from all logical constraints. The faces of the second story defining cube 52 need not all be imprinted with these legends, however, unless desired. For example, two or more of the faces can be imprinted with legends or pictorial illustrations offering other options in the game, these being indicated in FIG. 2 by reference numeral 51 (Option #1) and 53 (Option #2), respectively. The main consideration is that at least two of the faces be imprinted either with the legends "Logical" or "Nonsense".

The frame-like member 18 can be of any suitable shape and configuration, so long as it provides the desired function. The main thing is that each frame-like member should provide a border or frame around a single pictorial illustration and legend shown on the game card 12, to provide an indication to that player and the others that the player has already told a story as indicated by the characterizing legend. In the practice of the invention, however, a conventional 35 mm slide mount has been found to be a most suitable frame-like member, matching up with, and framing an unmounted pictorial illustrations 42 shown on the game card. Although somewhat less desired, instead of a frame-like member 18, a means can be used which simply covers the pictorial illustration and legend, much like a token used in covering the number in playing Bingo. This "token" or cover means can be any shape desired, e.g., square, circular, irregular, so long as it performs the desired function. Moreover, but even less desirable, instead of a frame-like member 18, or the cover means above-disclosed, the game can include instead a tabular means for keeping track of the progress of the game. Thus, a tabular means could be provided for all the players, or for each player, such a tabular means being imprinted with the legends for the character of the stories to be told, and providing space for indicating whether that story has been successfully told, and a space for that player's name.

Other components that may be included in the basic game include Option Cards, the function of which will be disclosed hereinafter, and a means for measuring the length of time allotted to a player for beginning or telling a story. The timing device can be, for example, a simple hour glass. However, the time can be arbitrarily chosen, if desired, at the start of a game, for example, no more than two minutes. Or the time can be randomly determined for each player by a roll of the dotted die 48, providing a maximum story telling time of six minutes. Where the image cards are provided, as later fully disclosed, in the form of a perpetual calendar, a perpetual calendar device will, most desirably, be provided, to aid in determining the month's starting day.

In some cases, it may be desirable to provide a cover card 54, which card will provide a cover or lid for the base unit, hiding the game components from view when the game is not being played. In this case, the outer surface of the cover card 54 can be provided with a pictorial illustration or the like, making the game receptacle 10 more suitable as a wall hanging, if it is desired to additionally use it for that purpose. The rear face of the cover card can be imprinted with the game rules, etc., as desired.

As will be seen by reference to FIG. 1, a rectangular-shaped recess 56 is provided in the top surface 32 of the base unit 20, this recess being defined by vertically disposed planar end walls 60, 62, vertically disposed planar side walls 64, 66, and planar horizontally disposed bottom surface 68.

Extending upwardly from and integral with the bottom surface 68 are a plurality of vertical members 70, 72, 74, 76, each of which terminates in a planar, horizontally disposed top surface 78, 80, 82, 84, respectively, in a plane somewhat lower than the plane defined by the top surface 32, the reason for which will soon be disclosed.

The top surface 32, between vertical sidewalls 24, 64, is recessed and said recess terminates in a planar horizontally disposed bottom 86 in a plane defined by the top surface of vertical members 70, 72, 74, and 76. In that defined area there is provided a rectangular-shaped space for location of a trademark or the like for the game, if desired, as shown by reference numeral 88. The space defined by bottom 86 is defined on each side by recessed, elongated rectangular-shaped wells 90, 92, which may be used for holding image cards 14, if desired, during the play of the game. At each end of space 86, in the top surface 32, can be provided, if desired, arcuate-shaped finger wells 98, 100, to aid in removal of the cover card 54 from the base unit 20.

Well 90, as is seen from the drawing, is defined by vertically disposed side walls 102, 104, vertically disposed end walls 106, 108, and planar horizontally disposed well botton 110. In the bottom of this well, if desired, can be provided openings such as are indicated by reference numerals 112, 114, and 116, for use in hanging the game as a decorative wall piece. These openings can be provided, if desired, in addition to those openings 38, 40, earlier disclosed, or as an alternative thereto. In the event the game manufactured in accordance with the invention is provided with a narrow border 36, or no border at all, the location of openings 112, 114, 116 will be found most satisfactory. These openings, as will be appreciated, will need be large enough in diameter to accomodate the head of a suitable nail or other wall fastening device.

The rectangular-shaped well 92 is defined by vertically disposed end walls 118, 120 and side walls 64, 124 and horizontally disposed well bottom 126. The depth of the wells 90, 92 should be such in cooperation with the width thereof so that image cards 14 can be supported therein in an upright fashion during play of the game.

In bottom surface 68 of recess 56, as will be seen from FIG. 1 of the drawing, there are provided two pairs 128, 129 of spaced apart recesses, each of which contain two closely adjacent, rectangular-shaped recesses 130, 132 and 134, 136, respectively. The recesses in each pair are interconnected together by rectangular-shaped recessed channels 138, 140, which provide better access to the adjacent recesses, to aid in removal of the frame-like members 18, stored therein.

There are further provided in the bottom surface 68, two parallel, spaced-apart rectangular-shaped recesses 142, 144, for the storage of the game cubes used in the play of the game. These cubic-shaped recesses need only be large enough to accommodate the storage of three playing cubes in each well, aligned in a row. The ends of the wells should be rounded and extend slightly beyond the ends of the row of three playing cubes to allow the cubes to be more easily extracted. If desired these ends can slope downwardly from the top to the bottom of the wells, at the ends of the respective dice.

Optionally, there is provided in bottom surface 68, a circular-shaped recess 146 to accomodate the storage of a small square-shaped perpetual calendar, as identified by reference numeral 148. Such a calendar is available commercially and forms no part of this invention, in and of itself. The perpetual calendar 148 is used, in connection with the perpetual calendar that forms a part of the invention, to determine which day of the week starts the month concerned, as will be made clear later. Within recess 146, are provided posts 143, 145, 147, 149, terminating in planar horizontally disposed top surfaces for supporting perpetual calendar 148. The posts, as can be seen from the drawing, are located in the respective "corners" of recess 146 i.e., 90° from one another and their top surface should terminate in a plane that will allow the perpetual calendar 148 to be held just below the plane of bottom 68. Thus, the image cards 14, in the middle stack thereof will rest directly on bottom 68. Recess 146 should be deep enough to accomodate storage of tokens or extra wild cards, if desired.

As will be appreciated from what is shown in FIG. 1, during the time that the game is not being used, the frame-like members will be divided up in four equal-numbered groups and placed in the recesses 130, 132, 134, and 136. The game cards 12 and image cards 14 are divided up into three groups, the cards in each group, or stack, being superposed one above the other. The group of cards are then placed in the base unit 20 in three closely spaced horizontally disposed stacks or cards, defined as shown in the drawing by vertical members 70, 72, 74, and 76. The plane defined by the top cards in the three stacks should desirably roughly coincide with, or be slightly lower than that defined by the top surfaces 78, 80, 82 and 84 of the said vertical members. Cover card 54 fits somewhat snugly within the inner rectangular recessed area defined in top surface 32, covering over and holding in place, with the help of cover 22, the various game components.

The cover 22 for base unit 20, as seen from FIG. 1 of the drawing, is defined by a horizontally disposed planar top 150, and vertically disposed end walls 152, 154 and vertically disposed side walls 156, 158. The side and end walls are turned out at the bottom, as shown, providing a horizontally disposed rim 160. When the cover 22 is placed on base unit 20, rim 160 will rest on and butt against border 36, providing ease in removing the cover 22 from base unit 20, whenever desired.

Although not shown in the drawing, cover 22 can be provided with a rectangular-shaped recess, if desired, in its lower portion providing a window through which can be viewed the images in the top most planar members bearing images. In this case, the relative positions of planar members 12 and 14, as now shown in FIG. 1, will be reversed. The dimensions of the window should be such as to completely expose the images but should not be so great as to show the edges of the image bearing planar members or the other game components. The idea is more or less to provide a frame for the images, if the receptacle is used as a wall hanging. It will be apparent, of course, that in this case cover card 54 will have been removed.

Attention can be further focused on the images by providing that the portion of the cover 22 which desirably is of a clear plastic material, surrounding the window is frosted or otherwise made opaque, leaving the window clear for viewing the images. This can be accomplished in accordance with conventional sandblasting techniques.

The recessed window in cover 22, in addition to functioning as a viewing window, also functions to hold the image bearing planar members 14 in place, if the receptacle is used as a wall hanging. In this case the depth of the recess should be such to satisfactorily accomplish this purpose, but not so deep as to touch the top surfaces 78, 80, 82 and 84. A suitable depth of recess will stop about 1/16 inch short of touching those surfaces.

The receptacle 10 for the game can be provided, as desired, of various materials of construction. However, in the practice of this invention, both cover 22 and base unit 20 have been manufactured from conventional plastic materials. Various of such materials now used in games or for similar type receptacles can be used, for example polyethylene, polypropylene, polyvinyl chloride, polystyrene etc. These plastic and other materials can be formulated according to usual techniques to give any properties desired in the receptacle, for example, strength, rigidity, etc. The receptacles can be provided of various colors, or be provided clear, as desired. The cover 22 and base unit 20 can be molded according to various well known and conventional techniques, e.g., injection molding, vacuum molding, thermoforming, etc. As will be appreciated by those skilled in the molding art, the vertically disposed outer sides and end walls of the base unit should incline slightly from the vertical, to aid in their manufacture and removal from the mold. Thus, these walls will taper slightly outwardly from the top surface to the interconnected bottom member 34. As will be appreciated, the side and end walls of cover 22 will be tapered in a complementary fashion. The corners of the base unit (and complementary cover) may, moreover, be provided with undercuts, as is conventionally done, if desired. This will help retain the cover on the base unit, when the receptacle 10 is hung vertically on a wall.

Optionally, a recess (not shown) can be provided in the bottom surface of the bottom member 34, for use in the storing of extra game components not then being used. Thus, when the cover card 54 is removed, the card can be placed in and used as a cover for the bottom recess.

In a more preferred aspect of the game of this invention, termed the "bound version" thereof, there are provided at least 19 cards bearing images such as referred to earlier by reference numeral 14, representing as hereinafter more fully discussed the 12 months of the year and the seven days of the week. Thus, in accordance with this aspect of the invention, there is provided a perpetual calendar 162 suitable for use either as a decorative calendar, or as a game component, or both, as desired.

Figure 6:
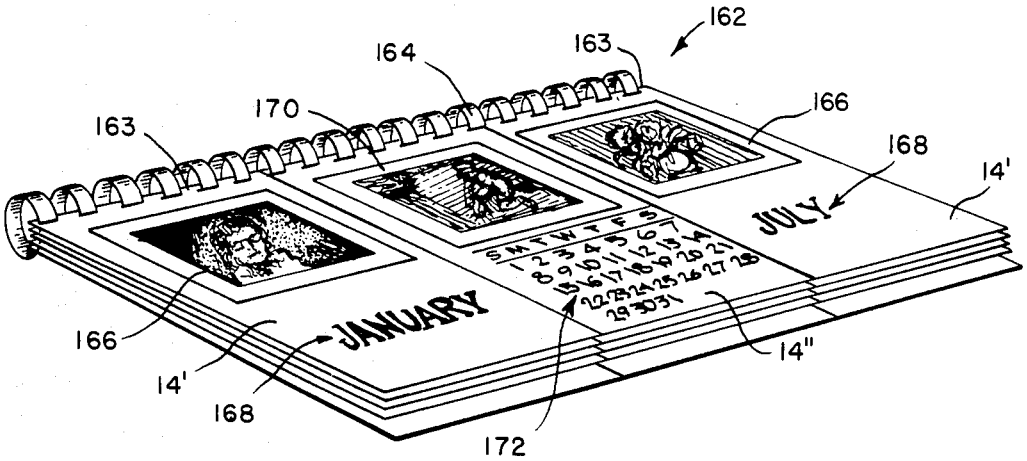
FIG. 6 is a view in perspective showing a bound version of the image bearing cards used in the game providing one embodiment of a perpetual calendar.

The perpetual calendar 162 of the invention, as will be more readily understandable by reference to FIG. 6 comprises a row of three stacks of superposed image cards, denoted by reference numerals 14', 14'' and 14', the cards in each stack being bound together along their top edges 163 by a conventional binding means 164. Various such binding means are commercially available of wire or plastic and any one can be used, so long as the image cards are presented in flip chart fashion. Thus, the upper most image card in any stack thereof can be flipped over, exposing the next image card down. Although not shown for sake of clarity, front and back cover members can be provided and bound with the image cards of the calendar, if desired. These can be blank, if desired, or imprinted with the game's name, etc., and can be provided of the same stock material as the image cards or of heavier stock. The cover members can be of one piece bridging the three rows or stacks of image cards, or the front cover member can be divided into three equal parts providing a front cover member for each stack of cards separate from the others.

In the perpetual calendar 162, as will be seen from FIG. 6, certain of the image cards, denoted by reference numeral 14', are imprinted with, in addition to, e.g., a desirable pictorial illustration such as a photograph represented by reference numeral 166, a legend such as indicated by reference numeral 168 denoting a particular month of the year. Others of the image cards, reference numeral 14'', are imprinted with, in addition to a suitable image 170, an array 172 of 31 numbers, arranged in calendar fashion. This array 172 of numbers is headed by a horizontal row of spaced-apart legends, one such a legend heading each vertical row of numbers, indicating the seven days of the week. The top image card in the stack bearing such an array will have the first day of the month beginning on Sunday, the card next below will have the first day of the month beginning on Monday and so on. The embodiment of the perpetual calendar 162 shown in FIG. 6 provides that the image cards 14'' bearing the calendar array 172 are located centrally between the two stacks of superposed image cards bearing the month legend. The stack of image cards 14' to the left of the calendar cards 14'' are superposed in such a fashion that the card bearing the legend for January is on top with the cards bearing the legend for the next succeeding month being located next below. The image cards 14' in the stack to the right of the calendar cards 14'' are superposed in similar sequential fashion with the top card bearing the legend for July.

It will be appreciated that, if desired, the stacks of image cards can be differently located in the perpetual calendar. For example, the calendar cards 14'' can be located in one of the outer positions; however, this is somewhat less desirable due to the lack of symmetry. Also, if desired, the stacks of image cards can be bound on separate spines, providing three separate and distinct units. Although not as preferred, the perpetual calendar 162 can comprise a set of loose cards.

In playing the first aspect of the game 10 disclosed herein, the cover card 54 is removed from base unit 20, exposing the three rows of game cards 12. These cards are removed and one is given to each player, the player placing it in front of his position. Any extra cards are set aside, or, in case one is provided, can be placed in the storage recess located in the bottom of the base unit. The image cards 14, located in this instance below game cards 12 are then removed and shuffled as one deck of cards to randomize their order, prior to play. This deck of image cards is then placed with the images facing downwardly. In the event Option Cards are provided, the purpose for which will soon be made clear, these are set aside for possible later use in the play of the game.

Once the image and game cards are removed for the base unit 20, the frame-like members 18 will be accessible and can be removed from their wells, if desired. However, it will be found that these wells provide a good storage place for the frame-like members, while the game is being played.

The players then, in turn roll the dotted die 48, to determine which player will start the game. The player rolling the highest number becomes the first player and the game then is played by each player taking his turn in clockwise fashion. In case there is a high number tie, those players tying only will roll the die again, to determine which player will go first. Alternately, the players can proceed in turn, corresponding to the next highest number rolled. In the event more than six players are involved, two numbered dice can be used, if desired. Preferably, the player rolling the highest number will start the game and the players will take their turns in clockwise (or counterclockwise) fashion, avoiding the repeated problem of multiple roll-offs in case of ties. A player cannot pass.

The first player then rolls simultaneously the three game dice 48, 50 and 52. The dotted die 48 will determine the number of image cards 14 that are to be randomly selected by that player from the deck of shuffled image cards, on which his story will be based. The story die 50 determines a primary characteristic of the story's content. The Logical/Nonsense die 52 will determine whether the story told should be logical or nonsensical. It may also indicate whether the player has the option to either (Option #1), after looking at the image cards selected, replace any one of those cards desired with any one of the Option Cards; or (Option #2) to roll all the dice 16 again. When Option #2 turns up on die 52 the player can, if desired, tell the kind of story determined by game cube 50. The player may either tell a "logical" or "nonsense" tale but need not declare which.

Based on his particular roll, and after exercising any options available, a player must attempt to tell a story, of the type indicated by die 50, that is derived from and includes information drawn from all of the image cards 14 randomly determined and selected. The story need not include all the specific information that is depicted in the image cards selected; however, the story need be based thereon and use at least part of the information contained in the image cards selected. The content of the story told must be of a character randomly determined by the throw of the playing cube 50. Whether the story told will be either logical or nonsensical is also randomly determined. Thus, if a player's roll of the dice turned up "four", "bold", and "logical", he would select four image cards from the shuffled deck and be required to tell a bold and logical story based on what is shown on the four image cards selected.

Once the player tells his story, which should be told in a reasonably short period of time, the other players vote on whether or not the story told included information from all the image cards 14 and matched that player's roll of the dice 50 and 52. When a majority of the players agree that the story told matches the roll, the player that told the story is awarded one of the frame-like members 18. That member 18 is then used to put around and frame the pictorial illustration on his game card 12 bearing the legend for the kind of story told.

The story telling player can also vote in determining whether or not his story matches the roll of the dice. Nevertheless, if that player's vote would create a tie, it will be disregarded.

Once a player has told a story, which that player did not yet have framed at the beginning of his turn, his turn ends and the next player, e.g., clockwise, rolls the three game cubes 16. That player then must tell a story, based on his roll of the dice, and the play passes to the next player clockwise, and so on. The winner of the game disclosed is the first player to have all the pictorial illustrations on his game card 12 framed.

In the event that a player, on his next turn at the roll of the dice, rolls the story die 50 and it turns up a type of story which has already been framed on his game card, that player can either end his turn, passing the playing cubes 16 on to the next player or the player can sacrifice his already received frame-like member in that category of story, in an effort to gain an extra turn. Nevertheless, if a player decides to make a sacrifice, this decision must be made before randomly selecting and looking at the image cards 14. With the decision to sacrifice, which can only be done by each player once each turn of play, the player draws the indicated number of image cards and attempts to tell the required story. If the player is successful, he retains his frame-like member about the story category involved and rolls the dice again for another turn. In case the player is unsuccessful, i.e., he fails to tell the required story, he loses the frame-like member for the story of the character concerned, and that member is returned to the well in the base unit. The manner of play can be, if desired, that the sacrificing player gives up the frame-like member when he announces a sacrifice and that member is returned to the storage unit. On being successful in telling the required story, the frame-like member 18 is then returned to the player and he once again places it on his game card 12, framing the pictorial illustration and appropriate story category legend.

In the event that two of the faces of the story defining cube 52 are provided with legends indicating "Option #1" and "Option #2", or appropriate symbols providing the same function, the game will be provided also with a plurality of Option Cards as desired. The number of Option Cards provided can, of course, be any number desired. The content of the Option Cards can be anything desired. For example an Option Card could allow a player to select an additional image card. Or, it could allow one selected to be discarded. Option cards could be provided with images, allowing substitution for an image card randomly selected.

If a player rolls "Option #1" on game cube 52, he may, but is not required, select an Option Card so designated. That Option Card selected will then determine what the player can do. For example, he may be able to substitute that card for any one of the image cards 14 randomly selected earlier. Thus, the number of image cards on which the player's story will be based will be the same, but the player has selected an Option Card bearing a more desirable image upon which to base his story, along with the earlier image cards 14 selected at random. This substitution is, of course, made after the player has seen the image cards drawn. The player next proceeds to tell the story of the character determined by story cube 50, not being limited by, or required to declare whether the story to be told will be logical or nonsensical.

If a player rolls "Option #2" on game cube 52, that player has the option of rolling all of the game cubes 16 again, or, if he chooses, to tell the kind of story determined by game cube 50. That story can be either logical or nonsensical as desired by the player but he need not declare which is going to be told.

At the outset of the game, the players elect one of several options regarding the "Wild" face of the story die 50. The first option is to simply tell a story that is on the "wild side", e.g., a story that may be somewhat bizarre or risque or make reference to natural or uncivilized habitats or creatures. A second option is to consider the "Wild" face as a chance to tell a story of one's own choosing from the characterizations on the other faces of the die. Or, when "Wild" comes up on the die, the story to be told can be selected by the player from a listing of story characterizations provided in the game or selected at that time by a majority of the other players. If desired, these other characterizations can even be provided on one or more additional story die, with these additional die used, if desired, when the "Wild" face turns up. Or upon such a roll occurring that player would make a selection from a deck of wild cards each of which indicates some story content or characteristic that must be woven into the story to be told based upon the image cards 14 selected. For example, the wild cards each might include some specific word, concept, person, place, thing, a song, a dance, a time limit for the story, etc. The wild card could be selected before or after the image cards are selected, as desired.

In the event that a player rolls "Wild", after having already framed "Wild" on his game card, he may, before selecting any image cards, challenge another player in a story category that the challenged player has already framed, but which he (the challenger) has not yet won. The challenged player would then have to tell a story based upon the challenger's roll of the dice, but would substitute the challenged story category for "Wild" and would select his own image cards. If the challenged player successfully tells the required story, that player then retains his frame for the story told. The challenger, in turn, loses the Wild frame on his game card. If the challenged player is unsuccessful in telling the required story, the challenger gets from the challenged player the frame for the challenged category and places that frame appropriately on his game card. The challenger's turn ends and the play goes on to the next player.

Figure 7:
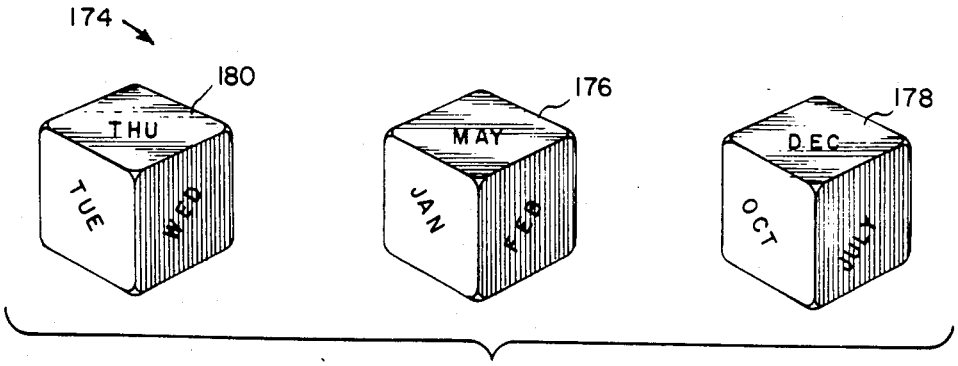
FIG. 7 is a view showing in perspective game cubes used with the bound/perpetual calendar version of the game.

In the bound version of the game, i.e., using the perpetual calendar 162, additional game cubes 174 will be provided as shown in FIG. 7. These game cubes consist of two cubes 176, 178, the faces of each of which are provided with legends indicating six months of the year. The faces of the third game cube 180 are each provided with a legend indicating the five days of the week, i.e., Monday–Friday. The sixth face is provided with the legend "Sat/Sun". The playing of the bound or calendar version of the game disclosed herein differs somewhat from that manner of play disclosed earlier. First of all, the numbered or dotted playing cube 48 is not used at all. The image cards to be used in the telling of this story are, instead, determined randomly by the playing cubes 176, 178, and 180. Thus, a player rolls the five playing cubes or dice 50, 52, 176, 178, and 180. If the roll turns up "lucky", "nonsensical", January, September and Wednesday, the player will turn to the image cards so indicated in the perpetual calendar and base the content of his "lucky", "nonsensical" story on something found in those images presented.

It will be appreciated by those skilled in the art that other bound versions of the game, with a greater or lesser number of stacks of image cards, can be provided within the parameters of my invention. For example, rather than coding the image cards by month and day, the image cards in a particular stack of cards could be numbered and each stack could be of a different colored binder. Thus, the three playing cubes provided to determine the image cards to be used would be of three different colors corresponding to those of the binders. The cubes could be provided with either dots or numbers, indicating, for example, on a roll of three the selection of the third card down from the top in the stack of cards bound by the binder the same color as the cube.

Although the perpetual calendar version of the game has been specifically disclosed as a "bound" version, those skilled in the art will readily appreciate that this need not be the case. The image cards 14 can be presented as unbound calendar cards in the game, if desired. In this case, instead of shuffling the image cards and placing them in a stack face down for random selection, the calendar cards can be presented face up. Their random selection is determined by the throw of the playing cubes 176, 178, 180.

As many different embodiments of this invention will now have occurred to those skilled in the art, it is to be understood that the specific embodiments of the invention as presented herein are intended by way of illustration only and are not limiting on the invention, but that the limitations thereon can be determined only from the appended claims.

What I claim is:

1. Game for stimulating innovation and exercising fundamental thinking and communication skills comprising, in combination, a plurality of first named planar members, each of a predetermined size and shape and to be used by a player of the game, a plurality of spaced-apart pictorial iilustrations being affixed to and on each said first named planar members, each said pictorial illustration being provided with a legend specifying a different primary characteristic of a story to be told by a player of the game, the same pictorial illustrations and legends being provided on each of said first named planar members, a plurality of second named planar members, a different image being affixed to and on, and expressed by each said second named planar member, means for randomly determining the number of said second named planar members for use by a game player in making up and telling a story during the play of the game, means for randomly determining that certain primary characteristic of the said story to be told by a player, the said certain characteristics determined by the said random means corresponding to the legends provided on said first named planar members, and means for use by each player in association with said first named planar member being used by a player during the play of the game for recording and indicating that the said story of the randomly determined characteristic has been told by that player.

2. Game according to claim 1 wherein said first named planar members are of rectangular shape and six said pictorial illustrations are provided on each said member, said pictorial illustrations being arranged in two parallel rows, three illustrations being provided in each said row.

3. Game according to claim 2 wherein the said second named planar members are of rectangular shape and of the same overall dimension as said first named planar members.

4. Game according to claim 3 wherein said means for randomly determining the number of said second named planar members to be selected and used by a player in the making up and telling of a story is a multi-faced die, the faces of which are each provided with means indicating a number desired.

5. Game according to claim 4 wherein the means for randomly determining that said certain primary characteristic of the story to be told comprises at least one story defining cube, a legend being provided on each face of said cube for determining said primary characteristic of the story to be told.

6. Game according to claim 5 wherein the game further comprises a second story defining cube, and suitable legends are provided on at least certain faces of the said second cube for defining a further characteristic of the story to be told.

7. Game according to claim 6 wherein the said recording and indicating means is a frame like member for placement on and framing one of said pictorial illustrations, thereby recording and indicating to other players in the game that a story of that particular primary characteristic has been satisfactorily told by a player.

8. Game according to claim 7 wherein a legend is provided on certain of said second named planar members, in addition to the said image, indicating one of the twelve months of the year.

9. Game according to claim 8 wherein, in addition to the said image, an array of 31 numbers arranged in calendar fashion is provided on certain other of said second named planar members totaling seven in number, and a horizontal row of spaced-apart legends indicating the seven days of the week, starting with Sunday, head the array of numbers, each said array of numbers being such that the number 1 is on each said planar member on a different succeeding day of the week.

10. Game according to claim 9 wherein the said second named planar members are defined by a top edge and a bottom edge, the said planar members being arranged in a row of three stacks of superposed planar members, the said planar members bearing the array of numbers being the middle stack in the row and being superposed in such a fashion that the planar member bearing the number 1 on Sunday is the top most member with the next succeeding lower superposed members in turn being the member bearing the number 1 on the next succeeding day of the week, and the planar members bearing the legend for each month being provided in outer stacks on each side of said middle stack, the one said outer stack having the members superposed in such fashion that the member bearing the legend for January is on top and the members below that, in turn, bear the legend for the next succeeding five months, and the said planar members in the other said outer stack are superposed such that the member bearing the legend for July is on top with those members next below, in turn, bearing the next succeeding five remaining months, and means is provided for binding the three stacks of planar members together along their top edges in flip chart fashion.

11. Game according to claim 1 further comprising a rectangular-shaped receptacle for orderly storage of the said game components when not used in play, said receptacle comprising a rectangular-shaped base unit defined by parallel, vertically disposed, side and end walls, a horizontally disposed top surface, and a horizontally disposed bottom member parallel to said top surface and spaced apart therefrom by said side and end walls slightly larger in rectangular dimension than said top surface whereby a planar horizontally disposed border is provided around said side and end walls, a first-named rectangular-shaped recess in said top surface defined by vertically disposed side and end walls and a horizontally disposed bottom surface, and a plurality of spaced-apart vertically disposed members extending perpendicularly outwardly from one of said recessed side walls and upwardly from said bottom surface in said first named recess, each terminating in a planar horizontally disposed top in a plane lower than said top surface and defining a plurality of compartments whereby said first and second named planar members can be maintained in three separate and distinct stacks of superposed planar members and supported by said bottom surface in the same horizontally disposed plane, and a conforming rectangular-shaped cover for said base unit.

12. Game according to claim 11 wherein two pairs of closely adjacent spaced-apart second named recesses, in spaced-apart locations from one another are provided in said bottom surface providing storage wells for said recording and indicating means.

13. Game according to claim 12 wherein the second named recesses are of rectangular shape.

14. Game according to claim 13 wherein a recessed channel is provided in said bottom surface interconnecting together the said second named recesses in each pair whereby better access to the second named recesses is provided for removing the said recording and indicating means from the storage wells.

15. Game according to claim 14 wherein parallel, spaced-apart elongated recesses are provided in said top surface adjacent and parallel to the other of said recess side wall for holding in upright fashion the bottom edges of the said planar members bearing images which have been randomly selected about which a story is to be told.

16. Game according to claim 15 wherein said receptacle is of clear plastic material and spaced-apart openings are provided in said border of said rectangular-shaped receptacle whereby the said receptacle can be mounted to hang vertically downwardly on a wall surface when the game is not being played so as to enable the display of the images on the second named planar members.

17. Game according to claim 15 in which a rectangular-shaped space is provided between said parallel spaced-apart elongated recesses defining a top surface in the same plane as the plane defined by the tops of said vertically disposed members.

18. Game according to claim 17 wherein a cover card is provided having a pictorial illustration on its outer planar surface, and said cover card is supported by the tops of said vertically disposed members and said top surface of said rectangular-shaped space.

19. Game suitable for a plurality of players for stimulating innovation and exercising fundamental thinking and communication skills in each said player comprising, in combination, the following components:

(a) plurality of first named rectangular-shaped planar members of predetermined size and shape, a plurality of spaced-aprat pictorial illustrations being affixed to and one each of said first named planar members, said pictorial illustrations being six in number uniformly arranged in two parallel rows, and three illustrations being provided in each said row, each said pictorial illustration being provided with a different legend specifying a different primary characteristic of a story to be told by a player;

(b) plurality of second named planar members, an image being affixed to and on, and expressed by each said second named planar member, a legend being provided additionally on certain of said plurality of second named planar members, said legend indicating one of the twelve months of the year, an array of 31 numbers arranged in calendar fashion being provided on certain other of said second named planar members totalling seven different said members in number, and a horizontal row of spaced-apart legends indicating the seven days of the week, starting with Sunday, heading each said array of numbers, each said array of numbers being such that the number 1 is on each said planar member on a different succeeding day of the week, said second named planar members being of rectangular shape and each being defined by a top edge and a bottom edge, the said second named planar members being arranged in a row of three stacks of superposed planar members, the said planar members bearing the array of numbers being the middle stack in the row and being superposed in such a fashion that the planar member bearing the number 1 on Sunday is the top most member with the next succeeding lower superposed members in turn being the member bearing the number 1 on the next succeeding day of the week, and the second named planar members bearing the legend for each month being provided on outer stacks on each side of said middle stack, the one said outer stack having the members superposed in such fashion that the member bearing the legend for January is on top and the members below that, in turn, bear the legend for the next succeeding five months, and the said planar members in the other said outer stack are superposed such that the member bearing the legend for July is on top with those members next below, in turn, bearing the next succeeding five remaining months, and means is provided for binding the three stacks of planar members together along their top edges in flip chart fashion;

(c) three dice each of which is provided with six faces for randomly determining a predetermined number of said second named planar mexbers for use by a game player in telling a story, the faces of two said dice each being provided with a legend naming a month of the year, and the faces of the third said die each bearing a legend naming a day of the week, except that one face thereof bears the legend naming both Saturday and Sunday;

(d) a first story defining die having six faces each of which is provided with a legend corresponding with the legends on the first named planar members for determining the primary characteristic of the story to be told by a player;

(e) a second story defining die having six faces and suitable legends being provided on at least certain of said faces for defining other certain characteristics of the story to be told; and (f) a frame-like member for placement on and framing one of said pictorial illustrations on said first named planar member whereby to record and indicate to the other players that a story of that particular character has been satisfactorily told by a player.

* * * * *